United States Patent [19]

Schuck

[11] Patent Number: 4,610,414

[45] Date of Patent: Sep. 9, 1986

[54] EASEL

[76] Inventor: Paul E. Schuck, 8001 E. Broadway #518, Mesa, Ariz. 85208

[21] Appl. No.: 595,594

[22] Filed: Apr. 2, 1984

[51] Int. Cl.[4] ..... A47B 97/08

[52] U.S. Cl. ..... 248/449; 248/464

[58] Field of Search ..... 248/460, 449, 354.1, 248/464, 465

[56] References Cited

U.S. PATENT DOCUMENTS

| | | | |
|---|---|---|---|
| 374,116 | 11/1887 | Cross | 248/449 |
| 396,362 | 1/1889 | Marks | 248/449 |
| 544,083 | 8/1895 | Beyer | 248/449 |
| 1,415,602 | 5/1972 | Meyer | 248/354.1 |
| 3,809,354 | 5/1974 | Phifer | 248/449 |
| 3,926,398 | 12/1975 | Vincent | 248/460 |
| 4,109,892 | 8/1976 | Hartung | 248/449 |

*Primary Examiner*—Reinaldo P. Machado
*Assistant Examiner*—Alvin Chin-Shue

[57] ABSTRACT

An upright standard including a center work holder rack providing means of mounting two horizontal workpiece support holders that can readily secure workpieces of a differet height. The work holder rack and workpiece so retained may be readily adjusted to a selected working or display height by means of a unique rack support that permits height adjustments quickly and positively. The standard is supported in an upright position by rear legs with means of adjusting the working angle and which are collapsible to allow the easel to be reduced to a compact unit for storage and shipment.

1 Claim, 7 Drawing Figures

5
6
10
11
12
13
14
15
16
17
26
50

EASEL

BACKGROUND OF THE INVENTION

This invention relates in general to easels and in particular to easels that provide a quick adjustment feature that permits raising and lowering the workpiece.

Easels have heretofore been provided for supporting canvas, panels, or other workpieces on which a painting or lettering is to be made. A person using the easel positions himself and his painting arm selectively to reach the necessary areas of the workpiece. It is tiring and difficult for him to reach some areas of the workpiece.

It is frequently desirable to raise or lower the workpiece to suit the convenience of the person using the easel. Usually prior easel design included separately moveable work holder clamps which required separate adjustment in the selection of a desired working height. During adjustment the top and bottom work clamp devices were often required to be reset several times before the desired height was achieved. These awkward easel adjustments cannot be conveniently made by a person having full use of his hands and are even more difficult for a physically handicapped person.

In an effort to overcome certain shortcomings and to improve aspects of easel designs the following lists of patents disclose design features which have been conceived:

| PATENT NO. | PATENTEE | ISSUE DATE |
|---|---|---|
| 3,006,107 | Tolegian | Oct. 3, '61 |
| 3,926,398 | Vincent | Dec. 16, '75 |
| 3,759,482 | Wright | Sept. 18, '73 |

Tolegian discloses an easel design that permits raising and lowering the workpiece by means of two electrically actuated control switches. A hinge connection is provided between the base and the workpiece support frame to permit tilting from a vertical to an inclined position. The front of the base is mounted on two wheels to provide an easel which may be easily moved forwardly and rearwardly when required.

The Tolegian easel provides many desired features but does not permit easy folding for storage. Due to the excessive weight of this easel, motor, and control switches the necessity of wheels for moving this unit is obvious. This easel is bulky, heavy, and expensive to manufacture.

BACKGROUND OF THE INVENTION

Vincent discloses an easel design which incorporates an upright frame that supports a cross arm on an axis that is mounted to the frame. This cross arm is rotatable and has brackets that are adjustable to hold a workpiece blank of different sizes. The frame is supported in an upright position by a rear leg assembly which is collapsible to permit storage and shipment. The feature of providing an easel with means of rotating the workpiece is unique but not important to many artists. The workpiece support brackets that are mounted to the crossarm are locked into position by tightening the set screws. This means of locking is by friction and is not a positive lock. A heavy workpiece, canvas frame or panel board must be clamped securely to prevent it dropping to the floor. No positive means of securing the workpiece into their mounting bars is provided and can slide out when the work is rotated. These conditions are dangerous to the operators. The means of making the vertical adjustment require the operator to go to the rear of the easel to loosen and tighten two screws. The tripod type support does not permit stability equal to the four point support.

Wright discloses a tripod easel that includes an upright center support guide and internal slide bar that provide means of securing workpieces of different height. The workpiece may be adjusted to a selected working or display height.

The easel is supported in an upright position by three legs set in a triangular pattern. The rear leg is connected by a hinge to a slide plate which permits movement and adjustment of the support guide from a vertical or inclined position. All adjustments are retained by friction which is not a positive lock. The tripod type support does not provide a stable mounting for working on the workpiece.

Manufacturing cost to produce the Wright easel is prohibative due to the close tolerances required in the fit up of the guide bar and the internal slide bar. Also selected and expensive material is necessary to provide a quality product.

The above listed patents provide means of supporting a workpiece of different heights. The workpiece holders are mounted to a support bar that is adjustable in the vertical direction. The support frame can be tilted from a vertical to an inclined position. The rear leg supports are collapsible to allow the easel to be reduced to a compact unit for storage and shipment.

While the objectives of the above mentioned patents are common, they have not achieved them in an efficient or economical manner.

SUMMARY OF THE INVENTION

The present invention has aim to overcome such shortcomings of prior proposed easels mentioned above by providing a design that has many advantages and improvements.

The object is to provide an easel design that permits the workpiece to be moved to a selected height without releasing the workpiece from it's mounting. Another object is to provide a hinged connection between the easel frame and base frame to permit tilting from a vertical to an inclined position.

Still another object is to provide an easel that is designed to fold into a compact unit to permit storage and shipment. This can be accomplished without removing bolts or other hardware.

Still a further object of the present invention is to provide a means of raising the workpiece by merely lifting up on the rack cross member to the desired height. The rack will stay in this locked position automatically.

The means of lowering the workpiece is accomplished by applying pressure on the clutch extentions that releases the clutch instantly. When the workpiece is lowered to the desired height releasing the pressure will automatically lock the rack at this height.

The wide span of the four point base support provides stable characteristics that are necessary when larger workpieces are employed. An important object of the present invention is to present an easel construction that can be made from a variety of common grade materials. No special tooling is required for making the individual parts or for their assembly. Other objects and advantages of this invention will be apparent from the following description of the drawings explained in the embodiment of the invention.

DETAILED DESCRIPTION OF THE PREFERRED EMBODIMENT

Figure 1:
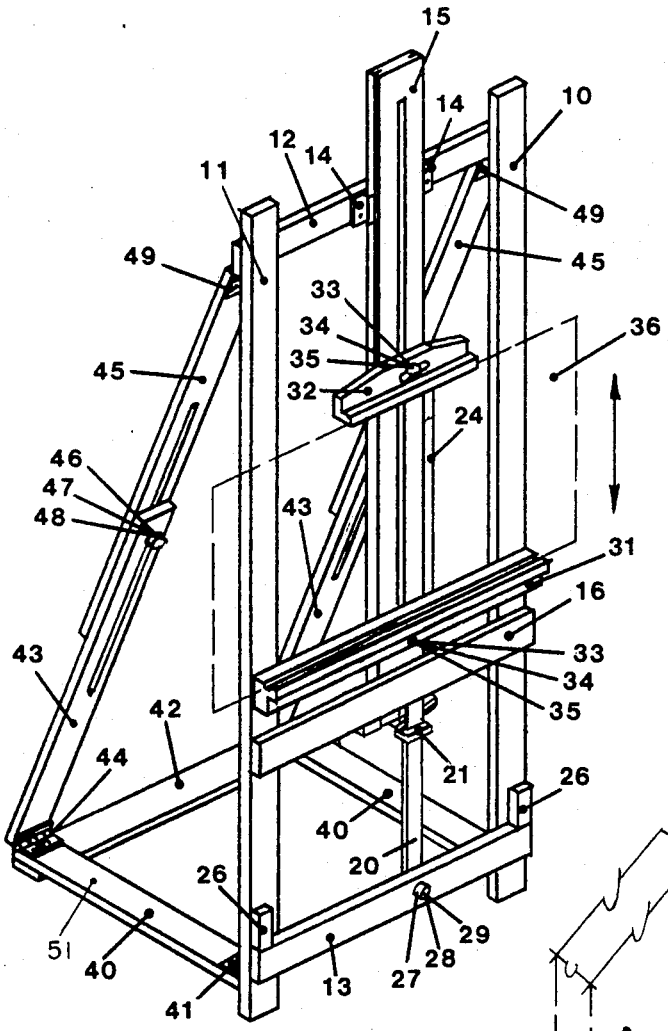
FIG. 1 is a perspective view of the easel embodying the present invention and a workpiece supported thereon being shown in phantom lines.
Figures 2, 2A, 3, 5, 6:
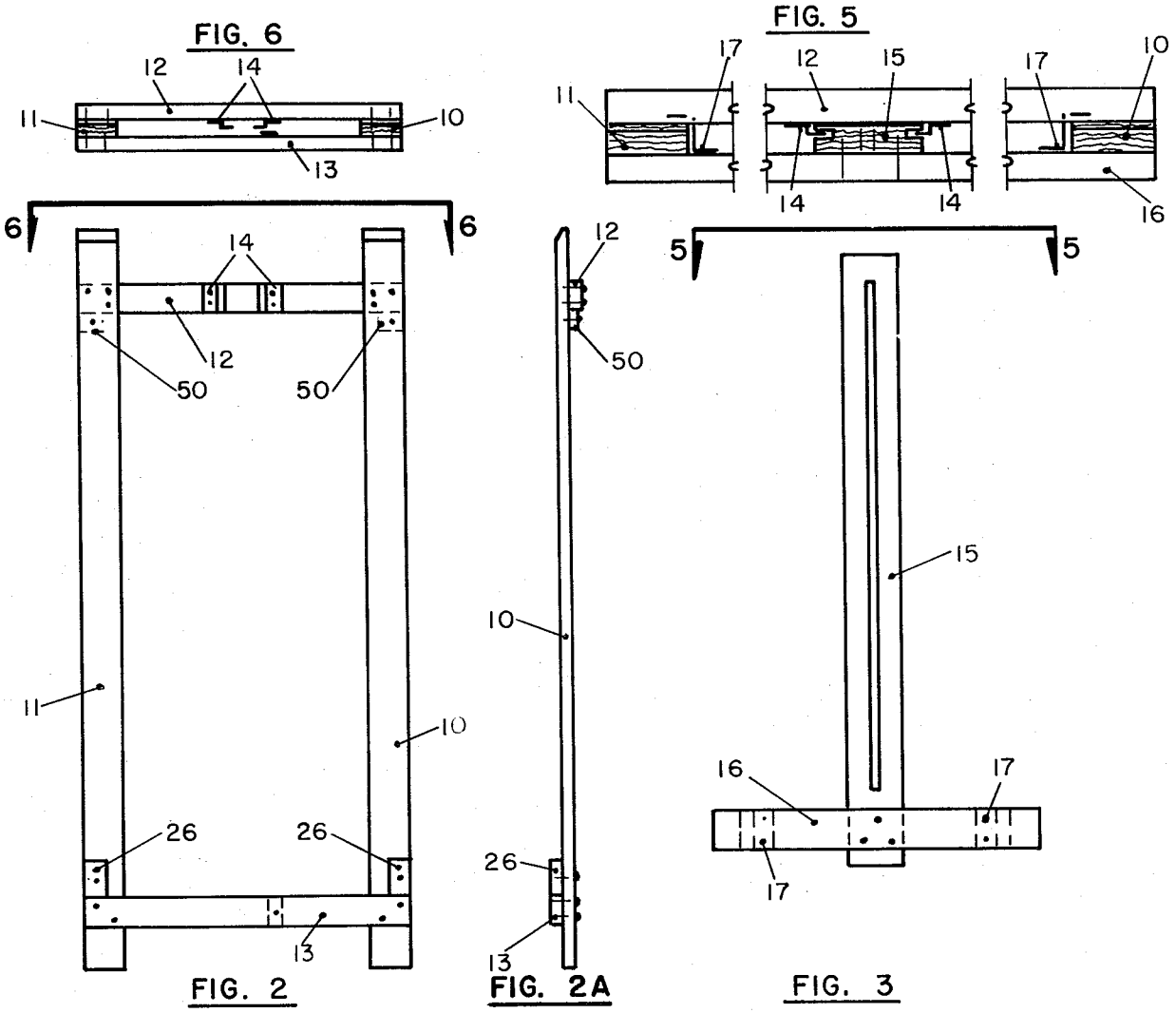
FIG. 2 is a front view of the standard in the erected position.
FIG. 2*a* is a side view of the standard in the erected position.
FIG. 3 is a front view of the work holder rack in the erected position.
FIG. 5 is a top view showing the relationship of the work holder to the standard.
FIG. 6 is a top view of the standard.

Referring to FIG. 1 there is illustrated a vertical frame assembly or standard as detailed in FIG. 2. This standard consists of two vertical side legs 10 and 11 and two horizontal cross bars 12 and 13. The bottom bar 13 is attached above the bottom far enough to clear the feet of the operator. These two cross bars are attached to each leg holding them parallel at the required distance apart. Two guides 14 are mounted to the center area of the top cross bar 12 to guide the center rack 15 which is part of the FIG. 3 work holder rack.

The work holder rack assembly FIG. 3 consists of a slotted center rack 15 and a cross bar 16 which is attached to the lower end of rack 15. The cross bar 16 is mounted perpendicular to the center rack 15 extending equal distance in each direction. Two guides 17 are attached to the bar 16 at equal distance from the center rack 15 at a distance necessary to clear the inside of the legs 10 and 11. The work holder rack FIG. 3 is stabilized and free to slide vertically within the standard assembly FIG. 2.

Figure 4:
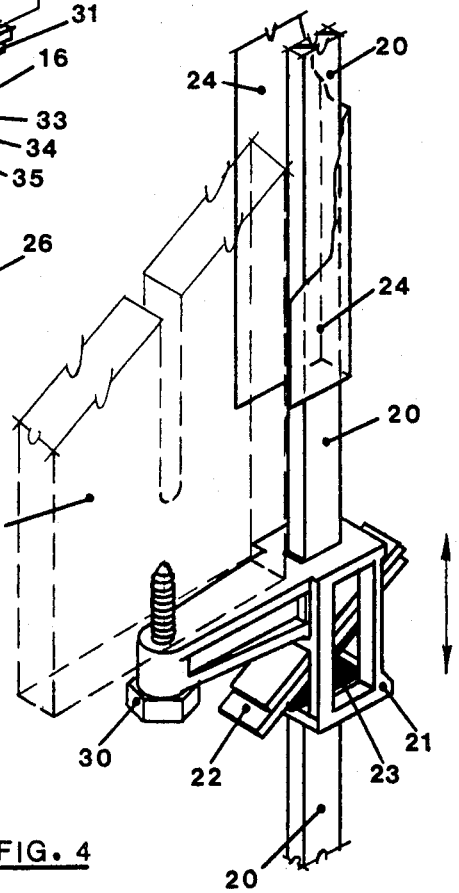
FIG. 4 is a fragmentary sectional view of the rack support.

The height of the work holder rack FIG. 3 is controlled by the rack support FIG. 4. This rack support consists of a steel bar 20 that slides through a slot in the head 21 which contains the clutch plates 22 and spring 23. The clutch plates 22 and spring 23 holds the head 21 any place along the bar 20. Slight pressure applied to the clutch plate extentions 22 releases the clutch instantly.

The lower end of the bar 20 is secured to the lower cross bar 13 of the standard assembly with bolt 27, washer 28, and nut 29.

The head 21 is connected to the bottom face of the rack 15 with screw 30. The height of the work holder rack FIG. 3 is performed manually and the desired height is held by the clutch plates 22. The guard 24 is placed around the upper end of the support bar 20 and secured to the slide of the rack 15.

The lowest position that the work holder rack FIG. 3 may be lowered is controlled by the stops 26. The maximum height that the rack assembly FIG. 3 can be raised is reached when the top end of guard 24 contacts the bottom of the cross bar 12.

Attachment of the workpiece holders 31 and 32 to the rack 15 is accomplished by bolts 33, washers 34 and wing nuts 35 mounted in the said workpiece holders and extending through the upright slot in the said rack 15. By suitable lightening and loosening of the wing nuts 35 the workpiece holders can be adjusted to various heights on the rack to support and engage a bottom and top edge of a workpiece indicated in phantom lines 36. The term workpiece is meant to include any planar sheet material, frame sheet material, display charts, canvas plates or boards, paintings, or the like adapted to be supported, displayed, and worked upon, as a painting.

A leg assembly supports the standard upright preferably in a slight rearward inclined position. This leg assembly is made up of five segments comprising two pair of upright segments 43 and 45 and a bottom horizontal base frame 51 consisting of two side boards 40 rigidly connected at the rear by a transverse bar 42. The front end of the base frame 51 has a hinged connection 41 adjacent to the front on side bars 40 to near the bottom and on the rear side of the standard FIG. 2 and connected to legs 10 and 11. The lower upright segments 43 have a hinged connection 44 mounted at the rear end of the base frame 51 and connected to legs 10 and 11. The other ends of these segments are connected to segments 45 by means of a bolt 46, washer 47, and a wing nut 48 mounted in the slots of each segment 43 and extending through an upright slot in each of the segments 45. Bolts 46 hold the segments 43 and 45 together but upon loosening them the segments 43 and 45 can be adjusted lengthwise relative to each other. The upper ends of segments 45 have a hinged connection 49 adjacent to the top and mounted to blocks 50 on the rear side of the standard FIG. 2.

The particular structure of the leg assembly in addition to providing a desired tilt to the standard, is collapsible to a flat position by loosening the bolts 46. The horizontal base frame 51 with the two upright segments 43 as a unit can be folded up flat to the rear of the standard assembly FIG. 2. The bolts 46 can be tightened in this collapsed position of the leg assembly to maintain such assembly rigidly in collapsed position.

It is understood that the form of my invention herein shown and described is to be taken as a preferred example of the same and that various changes and modifications may be made in the easel construction described above and all such changes in the shape, size and arrangement of parts may be resorted to without departing from the spirit of the invention, or the scope of the sub-joined claim.

Having thus described my invention, I claim:

1. An easel for supporting a picture, or workpiece, facewise to a person positioned in front of it comprising, a. an upright frame or standard, b. a rear leg assembly on said standard for supporting the latter in an upright position, c. said leg assembly including a rearwardly extending base frame hingedly connected at one of its ends to said standard and hingedly connected at its other end to one end of a pair of upright segments, d. the other end of each said pair of upright segments being connected with one end of a second pair of upright segments in a releasable slidable joint, e. said second pair of upright segments having their other ends hingedly connected to said standard above the hinged connections of said rearward extended base frame with the standard whereby said two pair of leg segments and base frame can be folded up against the back of said standard by releasing said slidable joint between said pair of upright segments and pivoting the rearward extending base frame and said second pair of upright segments toward the standard, f. a work holder rack comprising a slot and a lower cross bar movable along said standard means to a selected working height, means slidable mounting said work holder rack on said standard, g. said work holder rack being retained slidably inside of said standard by guides mounted to said work holder rack at each end of the lower cross bar enclosing inside edges of outer rails of said standard while upper end of said work holder rack is retained by guides that are mounted on top cross bar of said standard, h. a pair of vertically spaced workpiece support holder means slidably adjustable in the slot of the work holder rack and moveable therewith relative to the said standard without modifying the spacing between said workpiece holder means, i. a rack support on said standard, j. connecting means of said rack support on bottom cross bar of said standard extending upward and connected to bottom of said work holder rack whereby said workpiece support holders and picture blank thereon can be vertically positioned in front of the person, k. said connecting means comprising a fixed bar secured to said standard and extending vertically through an adjustable slotted head rigidly secured to said work holder rack, said slotted head contains several perforated locking clutch plates and spring to cant said locking clutch plates causing the edges of its perforations to grip the said bar and thus maintain the relative position of the fixed and adjustable members.

* * * * *